US009028023B2

(12) United States Patent
Tabata et al.

(10) Patent No.: US 9,028,023 B2
(45) Date of Patent: May 12, 2015

(54) FLUID EJECTION DEVICE AND FLUID EJECTION PRINTER WITH A POWER AMPLIFIER STOPPING SECTION

(71) Applicant: Seiko Epson Corporation, Tokyo (JP)

(72) Inventors: Kunio Tabata, Shiojiri (JP); Atsushi Oshima, Shiojiri (JP); Noritaka Ide, Shiojiri (JP); Shinichi Miyazaki, Suwa (JP); Hiroyuki Yoshino, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 14/512,302

(22) Filed: Oct. 10, 2014

(65) Prior Publication Data

US 2015/0029251 A1 Jan. 29, 2015

Related U.S. Application Data

(63) Continuation of application No. 14/103,704, filed on Dec. 11, 2013, now Pat. No. 8,894,170, which is a continuation of application No. 13/748,355, filed on Jan. 23, 2013, now Pat. No. 8,632,148, which is a continuation of application No. 12/821,324, filed on Jun. 23, 2010, now Pat. No. 8,382,224.

(30) Foreign Application Priority Data

Jun. 25, 2009 (JP) ..... 2009-151230

(51) Int. Cl.
*B41J 29/38* (2006.01)
*B41J 2/045* (2006.01)

(52) U.S. Cl.
CPC ..... *B41J 2/04588* (2013.01); *B41J 2/04541* (2013.01)

(58) Field of Classification Search
CPC .. B41J 2/04588; B41J 2/0452; B41J 2/04541; B41J 2/04548; B41J 2/0457; B41J 2/04581; B41J 2/04593
USPC ..... 347/9, 10, 14, 68, 70–72, 57–59
See application file for complete search history.

(56) References Cited

U.S. PATENT DOCUMENTS

| | | | |
|---|---|---|---|
| 7,571,989 | B2 | 8/2009 | Ishizaki |
| 7,758,140 | B2 | 7/2010 | Oshima et al. |
| 7,850,265 | B2 | 12/2010 | Ishizaki |
| 7,997,671 | B2 | 8/2011 | Ishizaki |
| 8,246,133 | B2 | 8/2012 | Oshima et al. |
| 8,262,180 | B2 | 9/2012 | Oshima et al. |

(Continued)

FOREIGN PATENT DOCUMENTS

| | | |
|---|---|---|
| JP | 2007-096364 A | 4/2007 |
| JP | 2007-168172 A | 7/2007 |

(Continued)

*Primary Examiner* — Juanita D Jackson
(74) *Attorney, Agent, or Firm* — Maschoff Brennan

(57) ABSTRACT

A fluid ejection device includes: a modulator adapted to pulse-modulate a drive waveform signal forming a basis of a drive signal of an actuator to obtain a modulated signal; a digital power amplifier circuit adapted to power-amplify the modulated signal to obtain a power-amplified modulated signal; a low pass filter adapted to smooth the power-amplified modulated signal to obtain the drive signal; and a power amplification stopping section operating when holding a voltage of the actuator constant.

16 Claims, 15 Drawing Sheets

(56) References Cited

U.S. PATENT DOCUMENTS

| | | | | |
|---|---|---|---|---|
| 8,382,224 | B2 * | 2/2013 | Tabata et al. | 347/9 |
| 8,632,148 | B2 * | 1/2014 | Tabata et al. | 347/9 |
| 8,657,399 | B2 | 2/2014 | Ide et al. | |
| 2006/0197561 | A1 | 9/2006 | Lee et al. | |
| 2008/0018683 | A1 | 1/2008 | Oshima et al. | |
| 2008/0018687 | A1 | 1/2008 | Tabata et al. | |

FOREIGN PATENT DOCUMENTS

| | | | |
|---|---|---|---|
| JP | 2007-190708 | A | 8/2007 |
| JP | 2007-216401 | A | 8/2007 |
| JP | 2008-049698 | A | 3/2008 |
| JP | 2008-049700 | A | 3/2008 |
| JP | 2008-087467 | A | 4/2008 |
| JP | 2008-148288 | A1 | 6/2008 |

* cited by examiner

| MEMORY ADDRESS N | OUTPUT VOLTAGE DIFFERENCE VALUE Vd | PWM FREQUENCY fpwm (KHz) |
|---|---|---|
| 0x00000000 | 0 | 0 |
| 0x00000001 | 0 | 0 |
| 0x00000002 | 0 | 0 |
| 0x00000003 | 2. 0 | 1000 |
| 0x00000004 | 2. 0 | 1000 |
| 0x00000005 | 2. 0 | 500 |
| 0x00000006 | 2. 0 | 1000 |
| 0x00000007 | 2. 0 | 1000 |
| 0x00000008 | 0 | 0 |
| 0x00000009 | 0 | 0 |
| 0x0000000A | 0 | 500 |
| 0x0000000B | 0 | 0 |
| 0x0000000C | −2. 0 | 1000 |
| 0x0000000D | −2. 0 | 1000 |
| 0x0000000E | −2. 0 | 500 |
| 0x0000000F | −2. 0 | 1000 |
| 0x00000010 | −2. 0 | 1000 |
| 0x00000011 | 0 | 0 |
| 0x00000012 | 0 | 0 |
| 0x00000013 | WAVEFORM TERMINATION DATA | 0 |

FIG.12

| MEMORY ADDRESS N | OUTPUT VOLTAGE VALUE V | DRIVE WAVEFORM STATES D0 D2 [3bit] | PWM FREQUENCY (KHz) |
|---|---|---|---|
| 0x00000000 | 0 | [0 0 0] | 0 |
| 0x00000001 | 0 | [0 0 0] | 0 |
| 0x00000002 | 0 | [0 0 0] | 0 |
| 0x00000003 | 2.0 | [0 1 1] | 1000 |
| 0x00000004 | 4.0 | [1 1 1] | 1000 |
| 0x00000005 | 6.0 | [1 1 1] | 500 |
| 0x00000006 | 8.0 | [1 1 1] | 1000 |
| 0x00000007 | 10.0 | [0 1 0] | 1000 |
| 0x00000008 | 10.0 | [0 0 0] | 0 |
| 0x00000009 | 10.0 | [0 0 0] | 0 |
| 0x0000000A | 10.0 | [1 0 1] | 500 |
| 0x0000000B | 10.0 | [1 0 0] | 0 |
| 0x0000000C | 8.0 | [0 0 1] | 1000 |
| 0x0000000D | 6.0 | [1 1 1] | 1000 |
| 0x0000000E | 4.0 | [1 1 1] | 500 |
| 0x0000000F | 2.0 | [1 1 1] | 1000 |
| 0x00000010 | 0 | [0 1 0] | 1000 |
| 0x00000011 | 0 | [0 0 0] | 0 |
| 0x00000012 | 0 | [0 0 0] | 0 |
| 0x00000013 | WAVEFORM TERMINATION DATA | [0 0 0] | 0 |

FIG.14

| MEMORY ADDRESS N | OUTPUT VOLTAGE VALUE V | PWM FREQUENCY (KHz) |
|---|---|---|
| 0x00000000 | 0 | 0 |
| 0x00000001 | 0 | 0 |
| 0x00000002 | 0 | 0 |
| 0x00000003 | 2. 0 | 1000 |
| 0x00000004 | 4. 0 | 1000 |
| 0x00000005 | 6. 0 | 500 |
| 0x00000006 | 8. 0 | 1000 |
| 0x00000007 | 10. 0 | 1000 |
| 0x00000008 | 10. 0 | 0 |
| 0x00000009 | 10. 0 | 0 |
| 0x0000000A | 10. 0 | 500 |
| 0x0000000B | 10. 0 | 0 |
| 0x0000000C | 8. 0 | 1000 |
| 0x0000000D | 6. 0 | 1000 |
| 0x0000000E | 4. 0 | 500 |
| 0x0000000F | 2. 0 | 1000 |
| 0x00000010 | 0 | 1000 |
| 0x00000011 | 0 | 0 |
| 0x00000012 | 0 | 0 |
| 0x00000013 | WAVEFORM TERMINA-TION DATA | 0 |

FIG.16

FLUID EJECTION DEVICE AND FLUID EJECTION PRINTER WITH A POWER AMPLIFIER STOPPING SECTION

This application is a continuation of U.S. application Ser. No. 14/103,704, filed Dec. 11, 2013, now issued as U.S. Pat. No. 8,894,170 which is a continuation of U.S. application Ser. No. 13/748,355 filed Jan. 23, 2013, now issued as U.S. Pat. No. 8,632,148 which is a Continuation of U.S. application Ser. No. 12/821,324, filed Jun. 23, 2010, now issued as U.S. Pat. No. 8,382,224 which claims priority to Japanese Application No. 2009-151230, filed Jun. 25, 2009. The foregoing patent applications are incorporated herein by reference.

BACKGROUND

1. Technical Field

The present invention relates to a fluid ejection device in which a drive signal is applied to an actuator to eject fluid, and is suitable for a fluid ejection printer adapted to, for example, eject small droplets from a nozzle of a fluid ejection head to form fine particles (dots) on a print medium, thereby printing a predetermined character, image, or the like.

2. Related Art

In the fluid ejection printer, there is provided an actuator such as a piezoelectric element in order for ejecting a droplet from the nozzle of the fluid ejection head, and it is required to apply a predetermined drive signal on the actuator. Since the drive signal has a relatively high voltage, it is required to power-amplify a drive waveform signal forming a basis of the drive signal with a power amplifier circuit. Therefore, in JP-A-2007-168172 (Document 1), there is used a digital power amplifier circuit, which has a smaller power loss compared to an analog power amplifier circuit and can be made smaller in size, a modulator executes pulse modulation on the drive waveform signal to obtain a modulated signal, the digital power amplifier circuit performs power amplification on the modulated signal to obtain a power-amplified modulated signal, and a low pass filter smoothes the power amplified modulated signal to obtain the drive signal.

In the fluid ejection printer described in the Document 1 mentioned above, the digital power amplifier circuit continues to operate even in the case in which the voltage of the drive signal does not change. Since the piezoelectric element used as the actuator of the fluid ejection printer is a capacitive load, even in the case in which the current supply to the actuator is stopped, the voltage of the actuator is kept at the voltage applied immediately before the stoppage. In other words, since the drive signal applied to the actuator or the drive waveform signal forming a basis thereof has a portion (period) with a voltage kept constant, it is not necessary to supply the actuator with a current when the voltage of the drive signal does not change. However, in the fluid ejection printer described in the Document 1 mentioned above, there arises a problem that the digital power amplifier circuit continues to operate, and therefore, the power is consumed in the digital amplifier circuit and the low pass filter even when the voltage of the drive signal does not change.

SUMMARY

An advantage of some aspects of the invention is to provide a fluid ejection device capable of reducing power consumption and a fluid ejection printer using the fluid ejection device.

A fluid ejection device according to an aspect of the invention includes a modulator adapted to pulse-modulate a drive waveform signal forming a basis of a drive signal of an actuator to obtain a modulated signal, a digital power amplifier circuit adapted to power-amplify the modulated signal to obtain a power-amplified modulated signal, a low pass filter adapted to smooth the power-amplified modulated signal to obtain the drive signal, and a power amplification stopping section operating when holding a voltage of the actuator constant.

According to the fluid ejection device of this aspect of the invention, since the operation of the digital power amplifier circuit is stopped when keeping the voltage of the actuator constant, or in other words, keeping the voltage of the drive waveform signal constant, power consumption in the digital power amplifier circuit and in the low pass filter is reduced.

Further, the digital power amplifier circuit has a switching element, and the power amplification stopping section stops the operation of the digital power amplifier circuit by setting all of the switching elements of the digital power amplifier off.

According to the fluid ejection device of this aspect of the invention, since all of the switching elements of the digital power amplifier circuit are off, these switching elements become to be in the high-impedance state, thus the discharge from the actuator (a capacitive load) is prevented.

Further, the modulator stops an output of the modulated signal when the operation of the digital power amplifier circuit is stopped by the power amplification stopping section.

According to the fluid ejection device of this aspect of the invention, since the output of the modulated signal itself is stopped, the power consumption of the modulator and the digital power amplifier circuit is reduced.

Further, the modulator pulse-modulates the drive waveform signal using a first modulation frequency, and the modulator increases the modulation frequency of the pulse modulation from the first modulation frequency when a voltage applied to the drive waveform signal changes from varying to constant.

According to the fluid ejection device of this aspect of the invention, a ripple voltage that causes distortion in the drive waveform signal when stopping the operation of the digital power amplifier circuit is suppressed to enable a waveform of the drive signal to become closer to a desired form.

The modulator pulse-modulates the drive waveform signal using a first modulation frequency, and the modulator increases the modulation frequency of the pulse modulation from the first modulation frequency when a voltage applied to the drive waveform signal changes from constant to varying.

According to the fluid ejection device of this aspect of the invention, a ripple voltage that causes distortion of the drive waveform signal when resuming the operation of the digital power amplifier circuit is suppressed.

When, for the purpose of explaining, a period in which the modulated signal is in a high level is referred to as a first period, and a period in which the modulated signal is in a low level is referred to as a second period, the modulator sets the modulated signal to be at the high level (or the low level) for a half the time of the first period (or the second period) immediately after the voltage of the drive waveform signal changes from constant to varying.

According to the fluid ejection device of this aspect of the invention, a ripple voltage that causes distortion of the drive waveform signal when the voltage of the drive waveform signal changes from constant to varying is suppressed.

Further, the power amplification stopping section temporarily resumes the operation of the digital power amplifier circuit during a stoppage of the operation of the digital power amplifier circuit.

According to the fluid ejection device of this aspect of the invention, a voltage drop by self-discharge in the actuator due to being a capacitive load.

A memory adapted to store the drive waveform signal is further provided, and the memory stores drive waveform voltage difference data.

According to the fluid ejection device of this aspect of the invention, whether the voltage applied to the drive waveform signal is varying or not may be easily determined.

A memory adapted to store the drive waveform signal is further provided, and the memory stores drive waveform voltage data and information regarding whether the voltage of the drive waveform signal is varying or not.

According to the fluid ejection device of this aspect of the invention, determining whether the voltage applied to the drive waveform signal is varying or not is no longer required.

A memory adapted to store the drive waveform signal is further provided, and the memory stores drive waveform voltage data, and the power amplification stopping section calculates a difference between the drive waveform voltage data retrieved from the memory, and stops the operation of the digital power amplifier circuit when the difference indicates a 0.

According to the fluid ejection device of this aspect of the invention, the memory with small capacity can be adopted.

Further, the memory stores a modulation frequency by the modulator.

According to the fluid ejection device of this aspect of the invention, it becomes possible to flexibly set the modulation frequency.

BRIEF DESCRIPTION OF THE DRAWINGS

The invention will be described with reference to the accompanying drawings, wherein like numbers reference like elements.

FIG. 12 is an explanatory diagram of the memory contents showing a first embodiment of the invention.

FIG. 14 is an explanatory diagram of the memory contents showing a second embodiment of the invention.

FIG. 16 is an explanatory diagram of the memory contents showing a third embodiment of the invention.

DESCRIPTION OF EXEMPLARY EMBODIMENTS

Then, as a first embodiment of the invention, a fluid ejection device applied to a fluid ejection printer will be explained.

Figure 1:
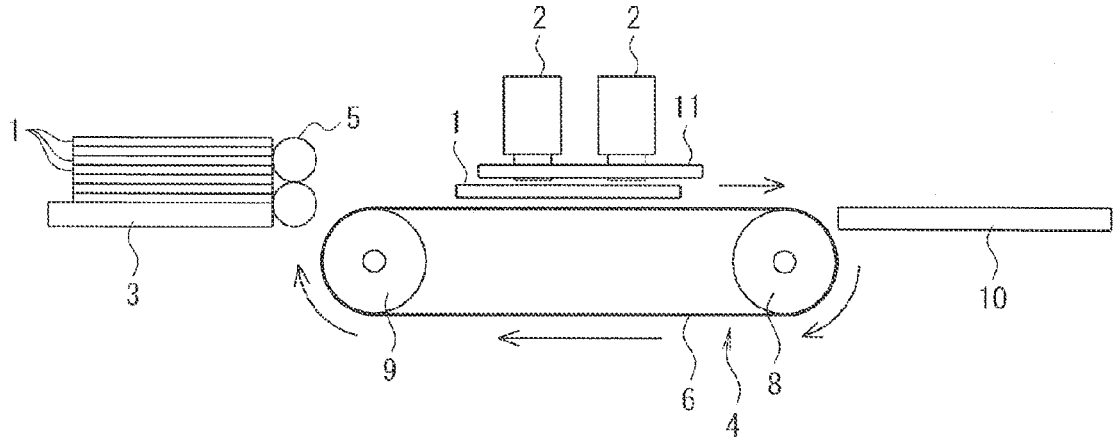
FIG. 1 is a front view of a schematic configuration showing a fluid ejection printer using a fluid ejection device as an embodiment of the invention.

FIG. 1 is a schematic configuration diagram of the fluid ejection printer according to the first embodiment, and in the drawing, the fluid ejection printer is a line head printer in which a print medium 1 is conveyed in the arrow direction from the left to the right of the drawing, and printed in a printing area midway of conveying.

Figure 2:
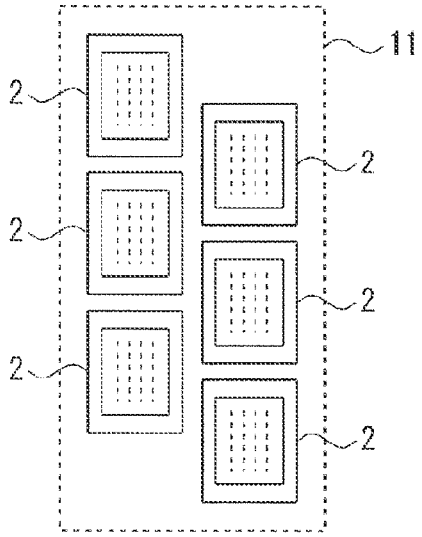
FIG. 2 is a plan view of the vicinity of fluid ejection heads used in the fluid ejection printer shown in FIG. 1.

The reference numeral 2 shown in FIG. 1 denotes a plurality of fluid ejection heads disposed above a conveying line of the print medium 1, which are fixed individually to a head fixing plate 11 in such a manner as to form two lines in the print medium conveying direction and to be arranged in a direction intersecting with the print medium conveying direction. The fluid ejection head 2 is provided with a number of nozzles on the lowermost surface thereof, and the surface is called a nozzle surface. As shown in FIG. 2, the nozzles are arranged to form lines in a direction intersecting with the print medium conveying direction color by color in accordance with the colors of the fluid to be ejected, and the lines are called nozzle lines, and the direction of the lines is called a nozzle line direction. Further, the nozzle lines of all of the fluid ejection heads 2 arranged in a direction intersecting with the print medium conveying direction constitute a line head covering the overall width of the print medium in a direction intersecting with the conveying direction of the print medium 1. When the print medium 1 passes through under the nozzle surface of the fluid ejection head 2, the fluid is ejected from a number of nozzles provided to the nozzle surface to thereby perform printing on the print medium 1.

The fluid ejection head 2 is supplied with fluids such as ink of four colors of yellow (Y), magenta (M), cyan (C), and black (K) from fluid tanks not shown via fluid supply tubes. Then, a necessary amount of fluid is ejected simultaneously from the nozzles provided to the fluid ejection heads 2 to necessary positions, thereby forming fine dots on the print medium 1. By executing the above for each of the colors, one-pass printing can be performed only by making the print medium 1 to be conveyed by a conveying section 4 pass through once.

As a method of ejecting a fluid from the nozzles of the fluid ejection head 2, there can be cited an electrostatic driving method, a piezoelectric driving method, a film boiling fluid ejection method, and so on, and in the first embodiment there is used the piezoelectric driving method. In the piezoelectric driving method, when a drive signal is applied to a piezoelectric element as an actuator, a diaphragm in a cavity is displaced to cause pressure variation in the cavity, and the fluid is ejected from the nozzle due to the pressure variation. Further, by controlling the wave height and the voltage variation gradient of the drive signal, it becomes possible to control the ejection amount of the fluid. It should be noted that the invention can also be applied to fluid ejection methods other than the piezoelectric driving method in a similar manner.

Under the fluid ejection head 2, there is disposed the conveying section 4 for conveying the print medium 1 in the conveying direction. The conveying section 4 is configured by winding a conveying belt 6 around a drive roller 8 and a driven roller 9, and an electric motor not shown is coupled to the drive roller 8. Further, in the inside of the conveying belt 6, there is disposed an adsorption device, not shown, for adsorbing the print medium 1 on the surface of the conveying belt 6. For the adsorption device there is used, for example, an air suction device for adsorbing the print medium 1 to the conveying belt 6 with negative pressure, or an electrostatic adsorption device for adsorbing the print medium 1 to the conveying belt 6 with electrostatic force. Therefore, when a feed roller 5 feeds just one sheet of the print medium 1 on the conveying belt 6 from a feeder section 3, and then the electric motor rotationally drives the drive roller 8, the conveying belt 6 is rotated in the print medium conveying direction, and the print medium 1 is conveyed while being adsorbed to the conveying belt 6 by the adsorption device. While conveying the print medium 1, printing is performed by ejecting the fluid from the fluid ejection heads 2. The print medium 1 on which printing has been performed is ejected to a catch tray 10 disposed on the downstream side in the conveying direction. It should be noted that a print reference signal output device formed of, for example, a linear encoder is attached to the conveying belt 6. Focusing attention on the fact that the conveying belt 6 and the print medium 1 conveyed by the conveying belt 6 while being adsorbed by the conveying belt 6 are moved in sync with each other, the print reference signal output device outputs a pulse signal corresponding to the print resolution required in conjunction with the movement of the conveying belt 6 after the print medium 1 passes through a predetermined position on the conveying path, and a drive circuit described later outputs a drive signal to the actuator in accordance with this pulse signal to thereby eject the fluid of a predetermined color at a predetermined position on the print medium 1, thus a predetermined image is drawn on the print medium 1 with the dots of the fluid.

Figure 3:
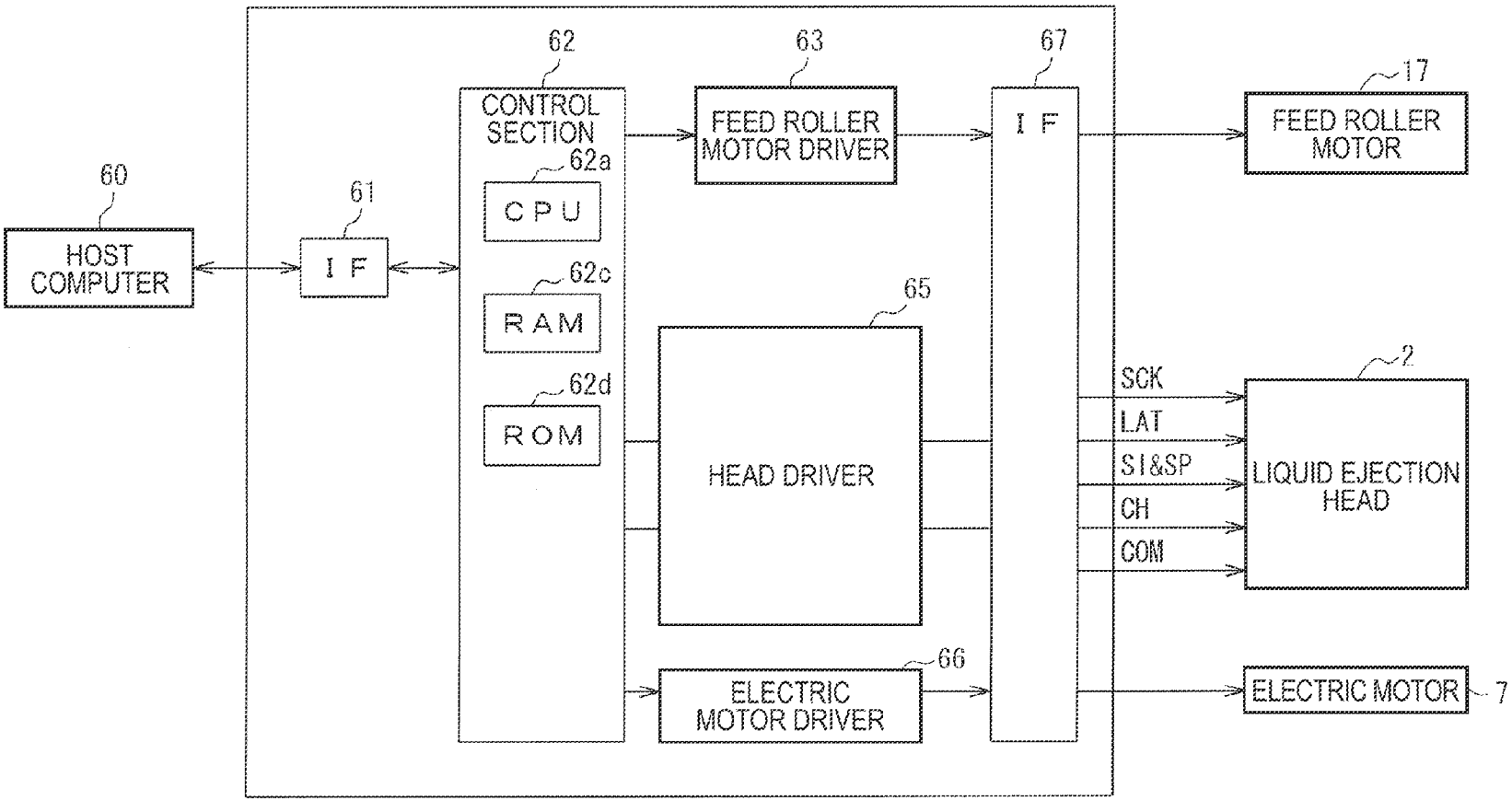
FIG. 3 is a block diagram of a control device of the fluid ejection printer shown in FIG. 1.

Inside the fluid ejection printer using the fluid ejection device according to the first embodiment, there is provided a control device for controlling the fluid ejection printer. As shown in FIG. 3, the control device is configured including an input interface 61 for reading print data input from a host computer 60, a control section 62 configured with a microcomputer for executing arithmetic processing such as a printing process in accordance with the print data input from the input interface 61, a feed roller motor driver 63 for controlling driving of a feed roller motor 17 coupled to the feed roller 5, a head driver 65 for controlling driving of the fluid ejection heads 2, and an electric motor driver 66 for controlling driving of an electric motor 7 coupled to the drive roller 8, and further including an interface 67 for connecting the feed roller motor driver 63, the head driver 65, and the electric motor driver 66, to the feed roller motor 17, the fluid ejection heads 2, and the electric motor 7, respectively.

The control section 62 is provided with a central processing unit (CPU) 62*a*, a random access memory (RAM) 62*c*, and a read-only memory (ROM) 62*d*. The CPU 62*a* executes various processes such as a printing process. The random access memory (RAM) 62*c* temporarily stores the print data input via the input interface 61 or data for executing, for example, the printing process of the print data, and temporarily develops a program of, for example, the printing process. The read-only memory (ROM) 62*d* is formed of a nonvolatile semiconductor memory for storing the control program and so on executed by the CPU 62*a*. The control section 62 obtains the print data (image data) from the host computer 60 via the input interface 61. Then, the CPU 62*a* executes a predetermined process on the print data to obtain nozzle selection data (drive pulse selection data) representing which nozzle the fluid is ejected from or how much fluid is ejected. Based on the print data, the drive pulse selection data, and input data from various sensors, drive signals and control signals are output to the feed roller motor driver 63, the head driver 65, and the electric motor driver 66. In accordance with these drive signals and control signals, the feed roller motor 17, the electric motor 7, actuators 22 inside the fluid ejection head 2, and so on operate individually, thus feeding, conveying, and ejection of the print medium 1, and the printing process to the print medium 1 are executed. It should be noted that the constituents inside the control section 62 are electrically connected to each other via a bus not shown in the drawings.

Figure 4:
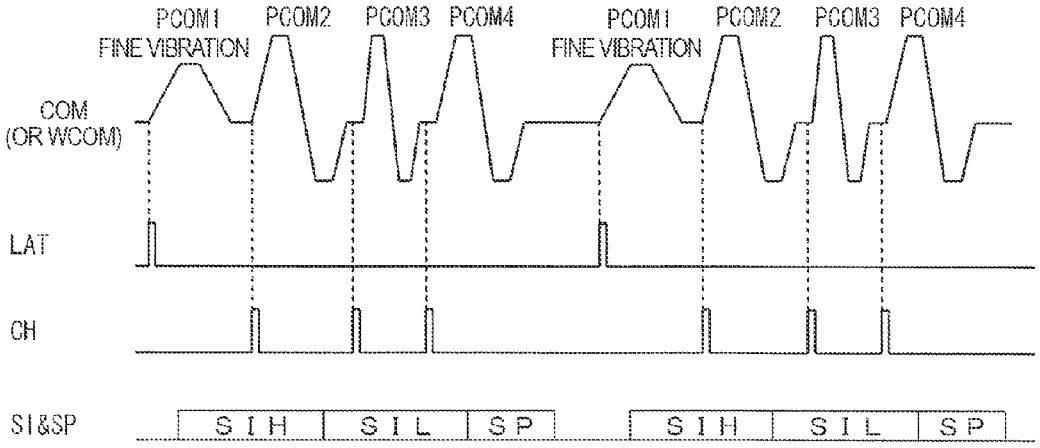
FIG. 4 is an explanatory diagram of a drive signal for driving actuators in each of the fluid ejection heads.

FIG. 4 shows an example of a drive signal COM supplied from the control device of the fluid ejection printer using the fluid ejection device according to the first embodiment to the fluid ejection heads 2, and for driving the actuators 22 each formed of a piezoelectric element. In the first embodiment, it is assumed that the signal has the electric potential varying around a midpoint potential. The drive signal COM is obtained by connecting drive pulses PCOM, each of which is a unit drive signal for driving the actuator 22 to eject the fluid, in a time-series manner. The rising portion of a drive pulse PCOM corresponds to a stage of expanding the volume of the cavity (a pressure chamber) communicating with the nozzle to pull-in (in other words, to pull-in the meniscus, in view of the ejection surface of the fluid) the fluid. The falling portion of the drive pulse PCOM corresponds to a stage of shrinking the volume of the cavity to push-out (in other words, to push-out the meniscus, in view of the ejection surface of the fluid) the fluid, and as a result of pushing out the fluid, the fluid is ejected from the nozzle.

By variously modifying the gradient of increase and decrease in voltage and the wave height of the drive pulse PCOM formed of trapezoidal voltage waves, the pull-in amount and the pull-in speed of the fluid, and the push-out amount and the push-out speed of the fluid can be modified, thus the ejection amount of the fluid can be varied to obtain the dots with different sizes. Therefore, even in the case in which a plurality of drive pulses PCOM are joined in a time-series manner, it is possible to select the single drive pulse PCOM from the drive pulses, and to supply the actuator 22 with the drive pulse PCOM to eject the fluid, or to select two or more drive pulses PCOM, and to supply them to the actuator 22 to eject the fluid two or more times, thereby obtaining the dots with various sizes. In other words, when the two or more droplets land on the same position before the droplets are dried, it brings substantially the same result as in the case of ejecting a larger amount of droplet, thus it is possible to increase the size of the dot. By a combination of such technologies, it becomes possible to achieve multiple tone printing. It should be noted that the drive pulse PCOM1 shown in the left end of FIG. 4 is only for pulling in the fluid without pushing it out. This is called a fine vibration, and is used for, for example, preventing thickening in the nozzle without ejecting the fluid.

Besides the drive signal COM described above, the drive pulse selection data SI&SP, a latch signal LAT, channel signal CH, and a clock signal SCK are input to the fluid ejection head 2 from the control device shown in FIG. 3 as the control signals. The drive pulse selection data SI&SP is used for selecting the nozzle ejecting the fluid based on the print data, and at the same time, determining the connection timing of the actuators 22 such as piezoelectric elements to the drive signal COM. The latch signal LAT and the channel signal CH connects the drive signal COM and the actuator 22 of the fluid ejection head 2 based on the drive pulse selection data SI&SP after the nozzle selection data is input to all of the nozzles. The clock signal SCK is used for transferring the drive pulse selection data SI&SP to the fluid ejection head 2 as a serial signal. It should be noted that it is hereinafter assumed that the minimum unit of the drive signal for driving the actuator 22 is the drive pulse PCOM, and the entire signal having the drive pulses PCOM joined with each other in a time-series manner is described as the drive signal COM. In other words, output of a string of drive signal COM is started in response to the latch signal LAT, and the drive pulse PCOM is output in response to each channel signal CH.

Figure 5:
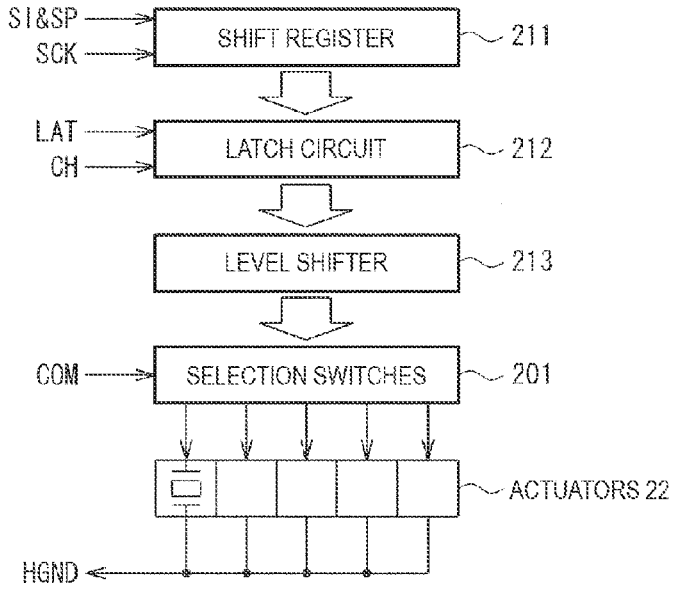
FIG. 5 is a block diagram of a switching controller.

FIG. 5 shows a configuration of a switching controller, which is built inside the fluid ejection head 2 in order for supplying the actuator 22 with the drive signal COM (the drive pulses PCOM). The switching controller is provided with a shift register 211, a latch circuit 212, and a level shifter 213. The shift register 211 stores the drive pulse selection data SI&SP for designating the actuators 22 such as piezoelectric elements corresponding to the nozzles for ejecting the fluid. The latch circuit 212 temporarily stores the data of the shift register 211. The level shifter 213 performs level conversion on the output of the latch circuit 212, and then supplies the result to a selection switch 201, thereby connecting the drive signal COM to the actuators 22 such as piezoelectric elements.

The drive pulse selection data SI&SP is sequentially input to the shift register 211, and at the same time, the storage area thereof is sequentially shifted from the first stage to the subsequent stage in accordance with the input pulse of the clock signal SCK. The latch circuit 212 latches the output signals of the shift register 211 in accordance with the latch signal LAT input thereto after the drive pulse selection data SI&SP corresponding to the number of nozzles has been stored in the shift register 211. The signals stored in the latch circuit 212 are converted by the level shifter 213 so as to have the voltage levels capable of switching on and off the selection switches 201 on the subsequent stage. This is because the drive signal COM has a relatively high voltage compared to the output voltage of the latch circuit 212, and the operating voltage range of the selection switches 201 is also set to be high in accordance therewith. Therefore, the actuator 22 such as a piezoelectric element, the selection switch 201 of which is closed by the level shifter 213, is coupled to the drive signal COM (the drive pulses PCOM) (switched on) at the coupling timing of the drive pulse selection data SI&SP. Further, after the drive pulse selection data SI&SP of the shift register 211 is stored in the latch circuit 212, the subsequent print information is input to the shift register 211, and the stored data in the latch circuit 212 is sequentially updated in sync with the fluid ejection timing. It should be noted that the reference symbol HGND in the drawing denotes the ground terminal for the actuators 22 such as piezoelectric elements. Further, even after the actuator 22 such as a piezoelectric element is separated from the drive signal COM (the drive pulses PCOM) (switched off), the selection switch 201 maintains the input voltage of the actuator 22 at the voltage applied thereto immediately before the separation.

Figure 6:
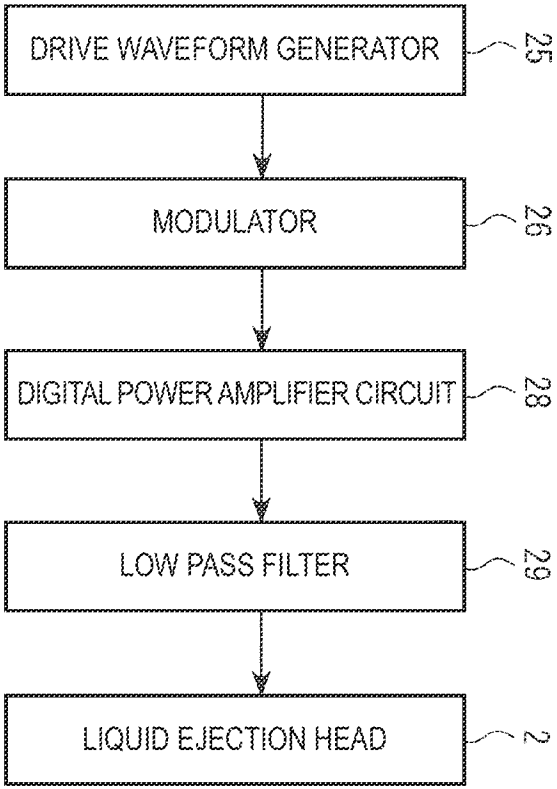
FIG. 6 is a block diagram of a drive circuit of the actuators.

FIG. 6 shows a schematic configuration of the drive circuit for the actuators 22. The actuator drive circuit is built inside the control section 62 and the head driver 65 included in the control circuit. The drive circuit of the first embodiment is configured including a drive waveform generator 25, a modulator 26, a digital power amplifier circuit 28, and a low pass filter 29. The drive waveform generation circuit 25 generates a basis of the drive signal COM (the drive pulses PCOM), namely a drive waveform signal WCOM forming a basis of the signal for controlling the drive of the actuator 22. The modulator 26 performs pulse modulation on the drive waveform signal WCOM generated by the drive waveform generator 25. The digital power amplifier circuit 28 power-amplifies the modulated signal pulse-modulated by the modulator 26. The low pass filter 29 smoothes the power-amplified modulated signal power-amplified by the digital power amplifier circuit 28, and then supplies the result to the fluid ejection heads 2 as the drive signal COM (the drive pulses PCOM). The drive signal COM (the drive pulses PCOM) is supplied from the selection switches 201 to the actuators 22.

Figure 7A:
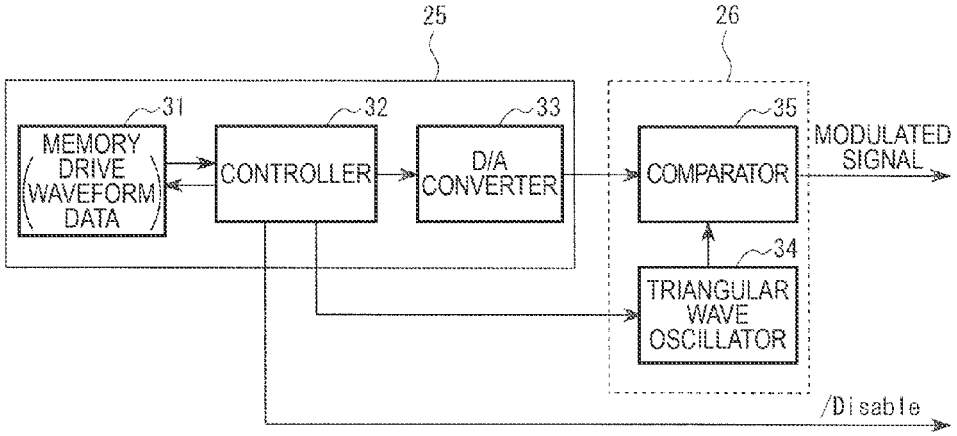
FIGS. 7A and 7B are detailed block diagrams showing an example of the drive circuit shown in FIG. 6.
Figure 7B:
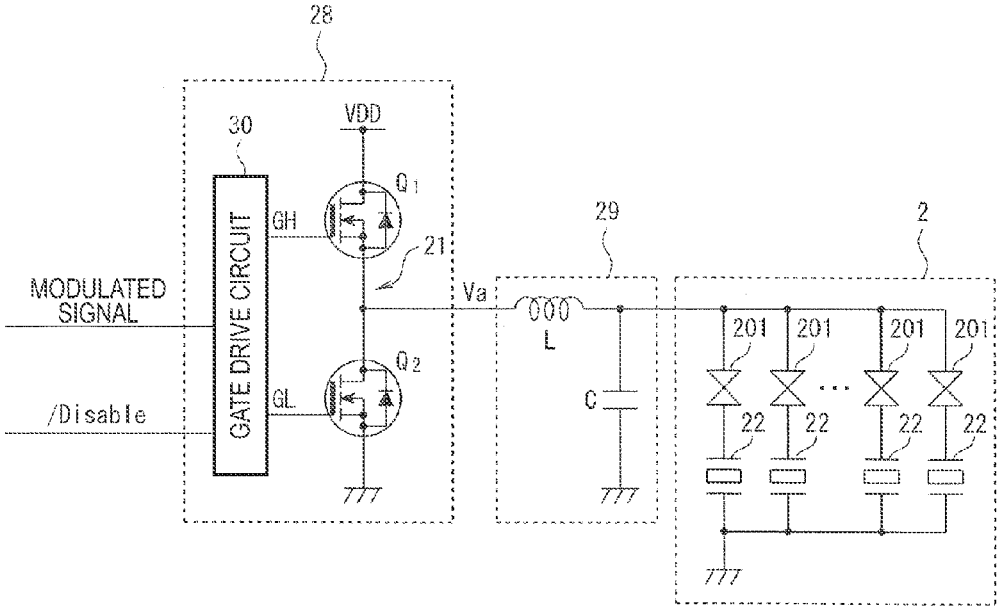

FIGS. 7A and 7B show a configuration of the actuator drive circuit. FIG. 7A shows the drive waveform generator 25 and the modulator 26, and FIG. 7B shows the digital power amplifier circuit 28, the low pass filter 29, and the fluid ejection heads 2. The drive waveform generator 25 is configured including a memory 31, a controller 32, and a D/A converter 33. The memory 31 stores drive waveform data of the drive waveform signal formed of digital voltage data or the like. The controller 32 converts the drive waveform data read from the memory 31 into a voltage signal, and then holds the result corresponding to a predetermined sampling period, and at the same time, instructs a triangular wave oscillator described later in a frequency and a waveform of a triangular wave signal, or a waveform output timing. The D/A converter 33 performs analog conversion on the voltage signal output from the controller 32, and outputs the result as the drive waveform signal WCOM. It should be noted that the controller 32 also outputs an operation stop signal/Disable for stopping the operation of the digital power amplifier circuit 28 to a gate drive circuit 30 described later in the digital power amplifier circuit 28. It is assumed that the operation of the digital power amplifier circuit 28 is stopped when the operation stop signal/Disable takes a low level.

Further, as the modulator 26, there is used a known pulse width modulator (PWM). The modulator 26 is provided with the triangular wave oscillator 34 for outputting the triangular wave signal forming a base signal in accordance with the frequency, the waveform, and the waveform output timing instructed from the controller 32 described above. A comparator 35 compares the drive waveform signal WCOM output from the D/A converter 33 with the triangular wave signal output from the triangular wave oscillator 34, and then outputs the modulated signal with a pulse duty cycle in which the on-duty represents that the drive waveform signal WCOM is higher than the triangular wave signal. It should be noted that the frequency of the triangular wave signal (the base signal) is defined as a modulation frequency (called, in general, a carrier frequency, for example). Further, as the modulator 26, there can be used a well-known pulse modulator such as a pulse density modulator (PDM) besides the above.

The digital power amplifier circuit 28 is configured including a half-bridge output stage 21 and the gate drive circuit 30. The half-bridge output stage 21 is composed of a high-side switching element Q1 and a low-side switching element Q2 for substantially amplifying the power. The gate drive circuit 30 controls the gate-source signals GH, GL of the high-side switching element Q1 and the low-side switching element Q2 based on the modulated signal from the modulator 26. In the digital power amplifier circuit 28, when the modulated signal is in the high level, the gate-source signal GH of the high-side switching element Q1 becomes in the high level, while the gate-source signal GL of the low-side switching element Q2 becomes in the low level. In other words, since the high-side switching element Q1 is set to be in a connected state ("ON") and the low-side switching element Q2 is set to be in an unconnected state ("OFF"), as a result, the output Va of the half-bridge output stage 21 becomes equal to a supply voltage VDD. On the other hand, when the modulated signal is in the low level, the gate-source signal GH of the high-side switching element Q1 becomes in the low level, while the gate-source signal GL of the low-side switching element Q2 becomes in the high level. In other words, since the high-side switching element Q1 is OFF and the low-side switching element Q2 is ON, as a result, the output Va of the half-bridge output stage 21 becomes 0.

In the case in which the high-side switching element Q1 and low-side switching element Q2 are driven digitally as described above, although a current flows through the switching element that is ON, the resistance value between the drain and the source is small, and therefore, the loss is hardly caused. Further, since no current flows in the switching element that is OFF, no loss is caused. Therefore, the loss itself of the digital power amplifier circuit 28 is extremely small, and therefore, it is possible to use small-sized switching elements such as MOSFETs.

It should be noted that when the operation stop signal/Disable output from the controller 32 is in the low level, the gate drive circuit 30 sets both of the high-side switching element Q1 and the low-side switching element Q2 OFF. As described above, when the digital power amplifier circuit 28 is in operation, either one of the high-side switching element Q1 and the low-side switching element Q2 is ON. Setting both of the high-side switching element Q1 and the low-side switching element Q2 OFF is equivalent to stopping the operation of the digital power amplifier circuit 28, which leads that the actuators 22 each formed of a piezoelectric element, the capacitive load from an electrical point of view, are kept in a high-impedance state. If the actuators 22 are kept in the high-impedance state, the charge stored in the actuators 22 as capacitive loads is held, and the charge/discharge state is maintained or restricted to a slight self-discharge state.

As the low pass filter 29, there is used a quadratic filter composed of one capacitor C and a coil L. The modulation frequency generated by the modulator 26, namely the frequency component of the pulse modulation, is attenuated to be removed by the low pass filter 29, and then the drive signal COM (the drive pulses PCOM) having the waveform characteristic described above is output. It should be noted that although FIGS. 7A and 7B show a form of a circuit for the sake of easiness of understanding, the drive waveform generator 25 and the modulator 26 can also be constituted by a program executed inside the control section 62 shown in FIG. 3. The low pass filter 29 can be configured using a stray inductance or a stray capacitance generated in the circuit wiring, the actuator, or the like, and is therefore not necessarily required to be formed as a circuit. Further, the memory 31 can also be formed inside the ROM 62*d*.

Figure 8:
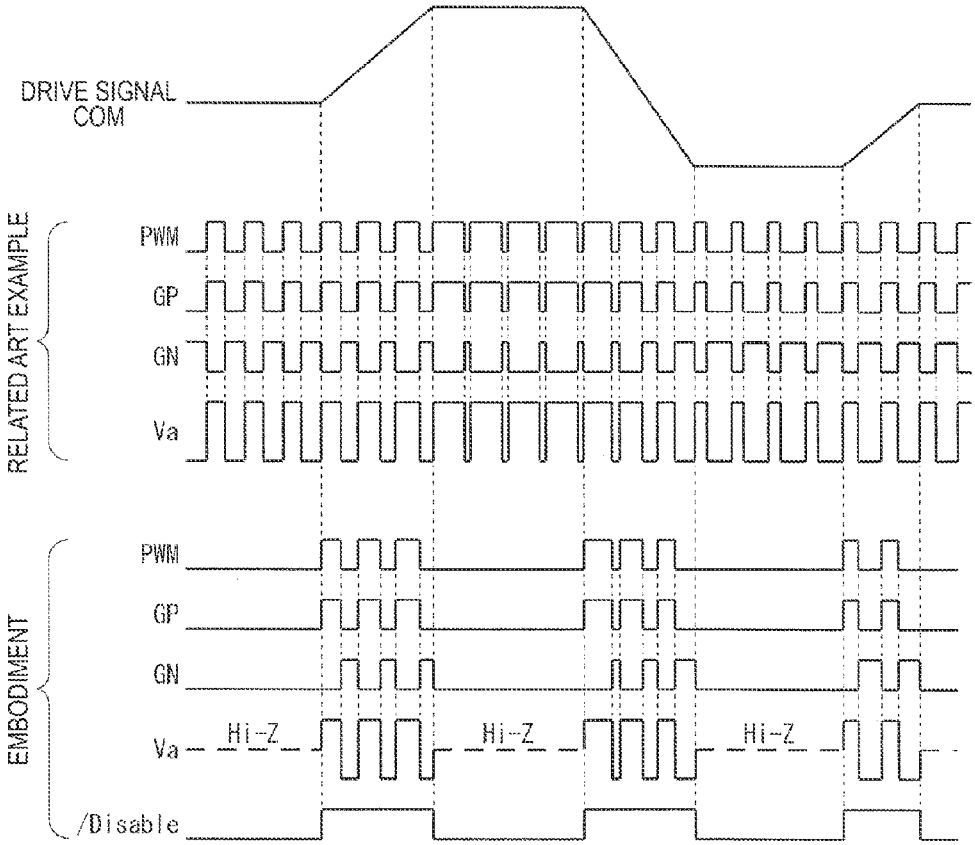
FIG. 8 is an explanatory diagram of a modulated signal, a gate-source signal, and an output signal in the drive circuit shown in FIGS. 7A and 7B.

FIG. 8 shows a control condition of the digital power amplification performed in the first embodiment. The upper part of FIG. 8 shows the condition of ordinary digital power amplification as a related art example, while the lower part of FIG. 8 shows a specific example of the digital power amplification control of the first embodiment. In the ordinary digital power amplification having been performed from the past, the digital power amplifier circuit is made to continue to operate constantly irrespective of whether or not the voltage of the drive signal COM varies. For example, since the digital power amplifier circuit used in the field of the audio engineering is premised on the fact that the input is varied constantly, there is no chance to stop the operation. On the other hand, since the actuator 22 such as a piezoelectric element is a capacitive load, there is no need to apply electrical current when the voltage of the drive signal COM does not vary. Despite the circumstance described above, if the high-side switching element Q1 and the low-side switching element Q2 of the digital power amplifier circuit 28 continues to be switched on/off, the power is consumed in the high-side switching element Q1, the low-side switching element Q2, and the coil L of the low pass filter 29.

Therefore, in the first embodiment, as shown in the truth table of Table 1 described below, when the voltage of the drive signal COM (the same can be applied to the drive waveform signal WCOM, which has not yet been power-amplified) does not vary, the operation stop signal/Disable is set to be in the low level to stop the operation of the digital power amplifier circuit 28, and further both of the high-side switching element Q1 and the low-side switching element Q2 are OFF. When setting both of the high-side switching element Q1 and the low-side switching element Q2 OFF, the actuators 22 as the capacitive loads are kept in the high-impedance state, and hence there is little of the self-discharge. Further, in the first embodiment, in the case of stopping the operation of the digital power amplifier circuit 28, namely when the voltage of the drive signal COM (the drive waveform signal WCOM) does not vary, output of the modulated signal PWM is also stopped (kept in the low level). Thus, the power consumption in the modulator 26 and the gate drive circuit 30 can also be reduced.

TABLE 1

| Pulse Modulation Signal | /Disable | Q1 | Q2 | Power Amplifier |
|---|---|---|---|---|
| 0 | 1 | OFF | ON | Operating |
| 1 | | ON | OFF | |
| 0 | 0 | OFF | | Stopped |
| 1 | | | | |

Incidentally, it is not possible to set both of the high-side switching element Q1 and the low-side switching element Q2 of the digital power amplifier circuit 28 OFF only by stopping the output of the modulated signal PWM (keeping the modulated signal PWM in the low level). This is because, when the modulated signal PWM is in the low level, the gate-source signal GH of the high-side switching element Q1 becomes in the low level, but the gate-source signal GL of the low-side switching element Q2 becomes in the high level, and consequently, the high-side switching element Q1 becomes OFF, but the low-side switching element Q2 becomes ON. Therefore, the gate drive circuit 30 sets both of the gate-source signal GH of the high-side switching element Q1 and the gate-source signal GL of the low-side switching element Q2 to be in the low level when the operation stop signal/Disable is in the low level, thereby setting both of the high-side switching element Q1 and the low-side switching element Q2 OFF.

Figure 9A:
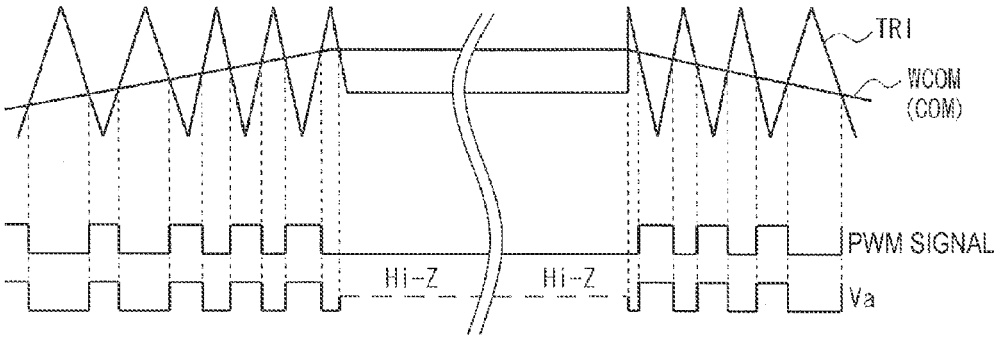
FIGS. 9A and 9B are detailed explanatory diagrams of the modulated signal shown in FIG. 8.
Figure 9B:
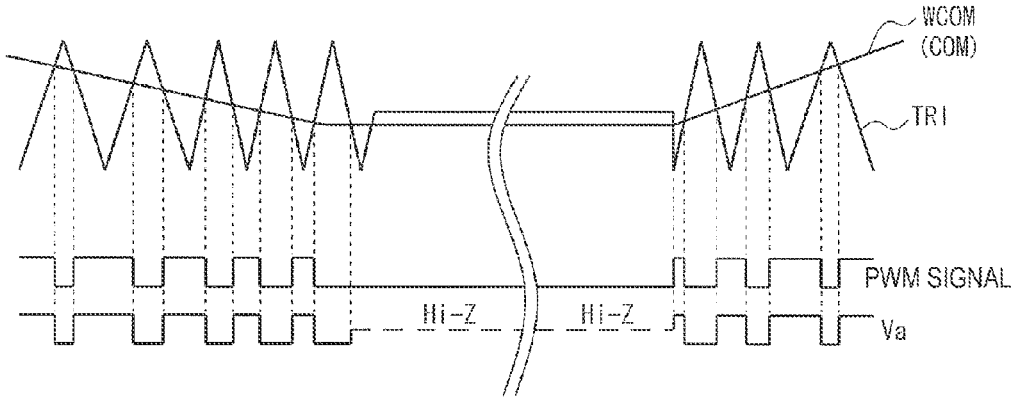

FIGS. 9A and 9B show the details of the PWM modulation performed in the modulator 26. FIG. 9A shows the state in which the voltage of the drive waveform signal WCOM gradually increases, and is then held constant, and then decreases gradually. Further, FIG. 9B shows the state in which the voltage of the drive waveform signal WCOM gradually decreases, and is then held constant, and then increases gradually. In the first embodiment, in both of the case in which the drive waveform signal WCOM increases and the case in which the drive waveform signal WCOM decreases, the modulation frequency (the frequency of the triangular wave signal TRI) of the pulse modulation is increased when the voltage of the drive waveform signal WCOM changes from varying to constant. Similarly, in both of the case in which the drive waveform signal WCOM increases and the case in which the drive waveform signal WCOM decreases, the modulation frequency (the frequency of the triangular wave signal TRI) of the pulse modulation is also increased when the voltage of the drive waveform signal WCOM changes from constant to varying. Specifically, the modulation frequency (the frequency of the triangular wave signal TRI) of the usual pulse modulation is set to be 500 kHz, and the modulation frequency (the frequency of the triangular wave signal TRI) of the pulse modulation when the voltage of the drive waveform signal WCOM changes from varying to constant or from constant to varying is set to be 1,000 kHz. According to the configuration described above, the ripple voltage of the drive signal COM in each of the transition periods can be prevented, and it becomes possible to match the voltage of the drive signal with no particular variation with the target value. It should be noted that the switching of the modulation frequency is not limited to two levels, it is also possible to increase the number of levels of the switching, or to vary the modulation frequency gradually.

Figure 10:
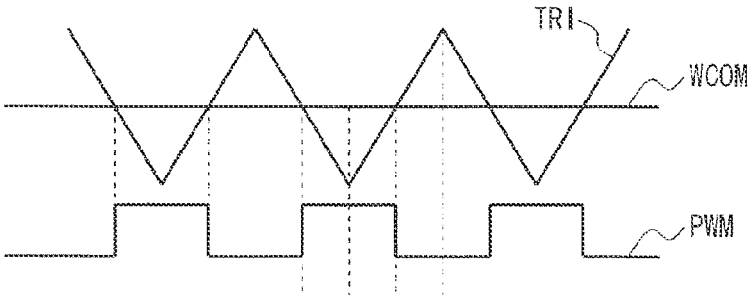
FIG. 10 is a detailed explanatory diagram of the modulated signal shown in FIGS. 9A and 9B.

Further, in the first embodiment, the period with the modulated signal PWM in either of the high level and the low level immediately after the voltage of the drive waveform signal WCOM changes from constant to varying is set to be a half of the period of the original modulated signal PWM. Specifically, since it is arranged that the modulated signal PWM becomes in the high level when the drive waveform signal WCOM is higher than the triangular wave signal TRI, and the modulated signal PWM becomes in the low level when the drive waveform signal WCOM is lower than the triangular wave signal TRI as shown in FIG. 10, by arranging that the output of the modulated signal PWM is started from the lower apexes of the triangular wave signal TRI, the period with the high level halves. Further, by arranging that the output of the modulated signal PWM is started from the upper apexes of the triangular wave signal TRI, the period with the low level halves. For example, in FIG. 9A, the controller 32 instructs the triangular wave oscillator 34 in the wave form and the waveform output timing of the triangular wave signal TRI so that the triangular wave signal TRI is started from the upper apex simultaneously with when the voltage of the drive waveform signal WCOM starts to decrease from a constant state. In contrast, in FIG. 9B, the controller 32 instructs the triangular wave oscillator 34 in the wave form and the waveform output timing of the triangular wave signal TRI so that the triangular wave signal TRI is started from the lower apex simultaneously with when the voltage of the drive waveform signal WCOM starts to increase from a constant state. Further, according to the process described above, the ripple voltage of the drive signal COM in each of the transition periods can be prevented.

Further, in the first embodiment, in the period in which the digital power amplifier circuit 28 stops the operation thereof, the operation of the digital power amplifier circuit is temporarily resumed. Specifically, the operation stop signal/Disable is set to be in the high level to resume the operation of the gate drive circuit 30, and at the same time, the modulated signal PWM is output from the modulator 26 to perform on/off control of the high-side switching element Q1 and the low-side switching element Q2 of the digital power amplifier circuit 28. Since the operation of the digital power amplifier circuit 28 is stopped when the voltage of the drive waveform signal WCOM does not vary, the voltage of the drive signal COM supplied to the actuators 22 is also the same as the voltage before and after the operation of the digital power amplifier circuit 28 is stopped. According to the process described above, it becomes possible to prevent the voltage drop due to the self-discharge of the actuators 22 made of capacitive loads.

Figure 11:
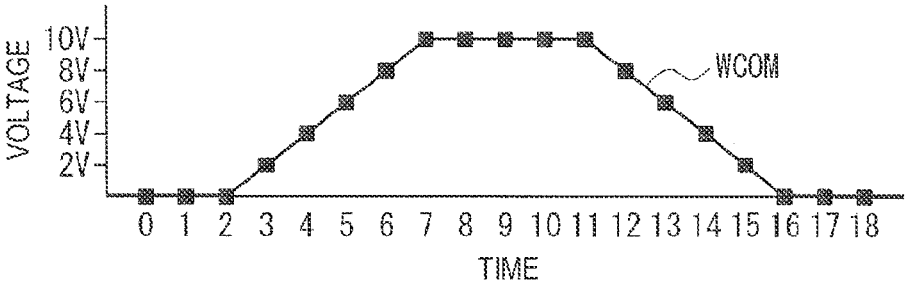
FIG. 11 is a waveform chart showing an example of a drive waveform signal.

For example, in the case in which the drive waveform signal WCOM takes the voltage of 0V in the periods 0 through 2, the voltage of 2V in the period 3, the voltage of 4V in the period 4, the voltage of 6V in the period 5, the voltage of 8V in the period 6, the voltage of 10V in the periods 7 through 11, the voltage of 8V in the period 12, the voltage of 6V in the period 13, the voltage of 4V in the period 14, the voltage of 2V in the period 15, and the voltage of 0V in the periods 16 through 18 as shown in FIG. 11, the memory 31 stores the data shown in FIG. 12, for example. In the first embodiment, the voltage difference between the adjacent periods is stored as an output voltage difference value Vd, and at the same time, the modulation frequency (the PWM frequency in the drawing) fpwm in each of the periods is also stored.

Figure 13:
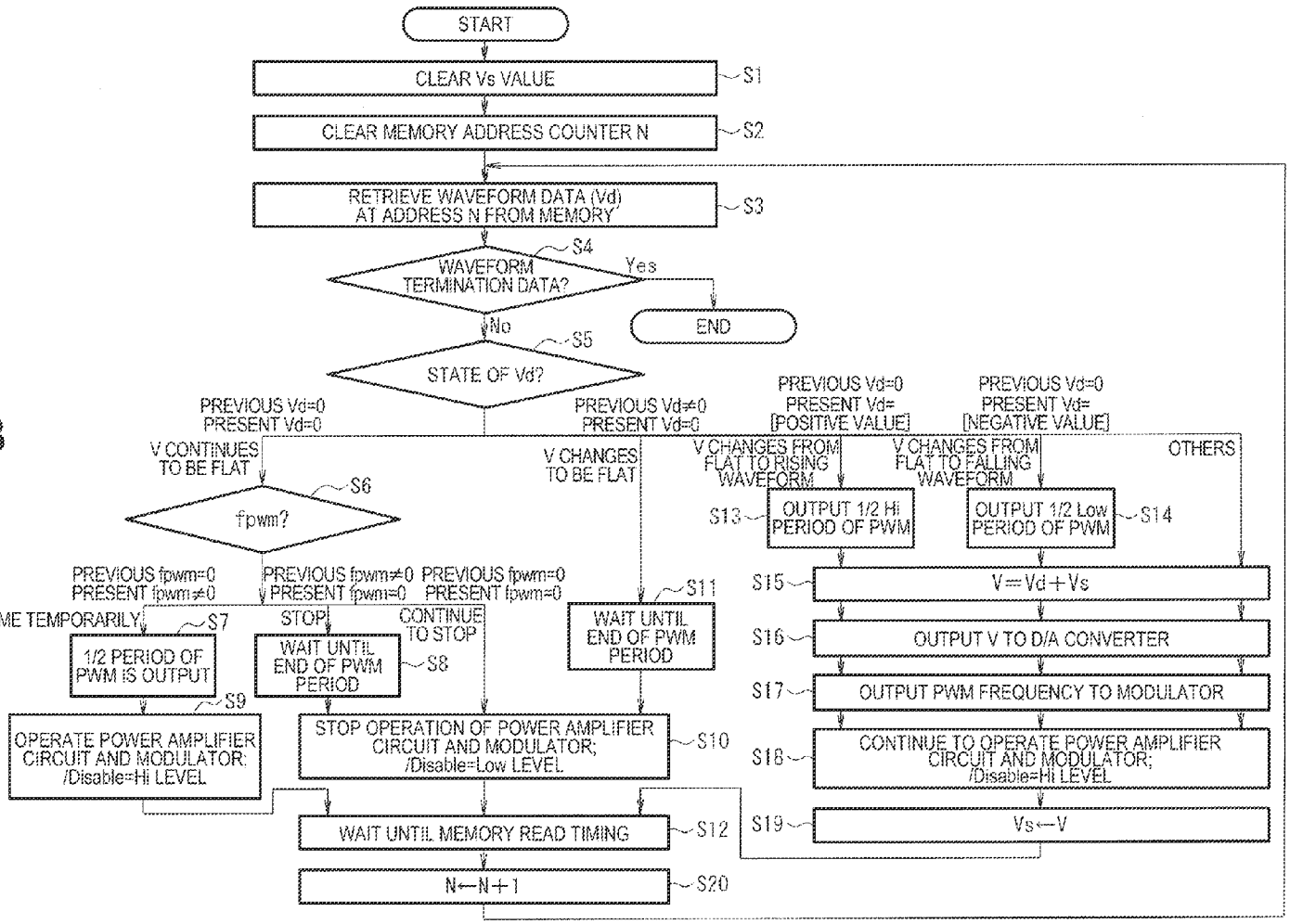
FIG. 13 is a flow chart of arithmetic processing performed by the controller shown in FIG. 7A in accordance with the memory contents shown in FIG. 12.

FIG. 13 is a flowchart of an arithmetic processing performed in the controller 32 using the data stored in the memory 31 shown in FIG. 12. In the arithmetic processing, firstly, a previous voltage value Vs is cleared in the step S1.

Then, the process proceeds to the step S2, and a memory address counter N is cleared.

Subsequently, the process proceeds to the step S3, and the waveform data (the output voltage difference value) Vd is retrieved from the memory 31.

Then, the process proceeds to the step S4, and whether or not the waveform data (the output voltage difference value) Vd retrieved in the step S3 is the waveform termination data is determined. If it is the waveform termination data, the arithmetic processing is terminated, and otherwise the process proceeds to the step S5.

In the step S5, determination of the waveform data (the output voltage difference value) Vd retrieved in the step S3 is performed. In this case, if the previous output voltage difference value Vd is 0, and the output voltage difference value Vd retrieved presently is also 0, the process proceeds to the step S6 on the ground that the voltage of the drive waveform signal WCOM is constant. Further, if the previous output voltage difference value Vd is not 0, and the output voltage difference value Vd retrieved presently is 0, the process proceeds to the step S11 on the ground that the voltage of the drive waveform signal WCOM changes to constant. If the previous output voltage difference value Vd is 0, and the output voltage difference value Vd retrieved presently takes a positive value, the process proceeds to the step S13 on the ground that the voltage of the drive waveform signal WCOM does not vary to the state of increasing the voltage occurs. Further, if the previous output voltage difference value Vd is 0, and the output voltage difference value Vd retrieved presently takes a negative value, the process proceeds to the step S14 on the ground that the voltage of the drive waveform signal WCOM changes from varying to constant. In other cases such as the case in which the previously-output voltage difference value Vd is not 0, and the output voltage difference value Vd last retrieved is not 0, the process proceeds to the step S15.

In the step S6, determination of the modulation frequency fpwm retrieved from the memory 31 is performed. In this case, if the previous modulation frequency fpwm is 0, and the modulation frequency fpwm retrieved presently is not 0, the process proceeds to the step S7 on the ground that the operation of the digital power amplifier circuit 28 is to be resumed temporarily. Further, if the previous modulation frequency fpwm is not 0, and the modulation frequency fpwm retrieved presently is 0, the process proceeds to the step S8 on the ground that the operation of the digital power amplifier circuit 28 is to be stopped. Further, if the previous modulation frequency fpwm is 0, and the modulation frequency fpwm retrieved presently is also 0, the process proceeds to the step S10 on the ground that the operation of the digital power amplifier circuit 28 continues to be stopped.

In the step S7, the on-duty period of the modulated signal PWM is reduced to half, and is then output, and the process proceeds to the step S9.

In the step S9, the operation stop signal/Disable is set to be in the high level to make the digital power amplifier circuit 28 and the modulator 26 operate, and the process proceeds to the step S12.

Further, in the step S8, the process waits until the end of the modulation period, and then proceeds to the step S10.

Further, also in the step S11, the process waits until the end of the modulation period, and then proceeds to the step S10.

In the step S10, the operation stop signal/Disable is set to be in the low level, and the operations of the digital power amplifier circuit 28 and the modulator 26 are stopped, and the process proceeds to the step S12.

Incidentally, in the step S13, by controlling the waveform and the waveform output timing of the triangular wave signal TRI as described above, the period in which the modulated signal PWM is kept in the high level is reduced to half of the period in which the original modulated signal is kept in the high level, and is then output, and the process proceeds to the step S15.

Further, in the step S14, by controlling the waveform and the waveform output timing of the triangular wave signal TRI as described above, the period in which the modulated signal PWM is kept in the low level is reduced to half of the period in which the original modulated signal is kept in the low level, and is then output, and the process proceeds to the step S15.

In the step S15, the output voltage difference value Vd is added to the previous voltage value Vs to thereby obtain a present voltage value V, and the process proceeds to the step S16.

In the step S16, the present voltage value V obtained in the step S15 is output to the D/A converter 33, and the process proceeds to the step S17.

In the step S17, the modulation frequency fpwm retrieved from the memory 31 is output to the modulator 26 (the triangular wave oscillator 34), and the process proceeds to the step S18.

In the step S18, the operation stop signal/Disable is set to be in the high level, and at the same time, the digital power amplifier circuit 28 and the modulator 26 are made to operate, and the process proceeds to the step S19.

In the step S19, the present voltage value V is stored as an update of the previous voltage value Vs, and then the process proceeds to the step S12.

In the step S12, the process waits until the read timing of the memory 31, and then proceeds to the step S20.

In the step S20, the memory address counter N is incremented, and then the process proceeds to the step S3.

According to this arithmetic processing, the operation of the digital power amplifier circuit 28 is stopped when the voltage of the drive signal COM does not vary, and consequently, there is no need to supply the actuators 22 with the current, namely when the voltage of the drive waveform signal WCOM does not vary, thereby making it possible to reduce an amount of power consumption in the high-side switching element Q1 and the low-side switching element Q2 constituting the digital power amplifier circuit 28, and the coil L inside the low pass filter 29.

Further, by setting both of the high-side switching element Q1 and the low-side switching element Q2 of the digital power amplifier circuit 28 OFF, it becomes possible to set the high-side switching element Q1 and the low-side switching element Q2 to be in the high-impedance state, thus it becomes possible to prevent the discharge from the actuators 22 as capacitive loads.

Further, by stopping the output of the modulated signal PWM itself in the case in which the operation of the digital power amplifier circuit 28 is stopped, the power consumption in the modulator 26 and the gate drive circuit 30 of the digital power amplifier circuit 28 can be reduced.

When the voltage of the drive waveform signal WCOM changes from varying to constant, the ripple voltage caused when stopping the operation of the digital power amplifier circuit 28 is preventable by increasing the modulation frequency fpwm of the pulse modulation, so as to match the voltage of the drive signal COM having no variation with the target value.

When the voltage of the drive waveform signal WCOM changes from constant to varying, the ripple voltage caused when resuming the operation of the digital power amplifier circuit 28 is preventable by increasing the modulation frequency fpwm of the pulse modulation.

Further, the period in which the modulated signal PWM is in the high level, immediately after the voltage of the drive waveform signal WCOM has changed from constant to increasing, is set to be a half of the period in which the original modulated signal PWM is in the high level, thus the ripple voltage can be prevented.

Further, the period in which the modulated signal PWM is in the low level, immediately after the voltage of the drive waveform signal WCOM has changed from constant to decreasing, is set to be a half of the period in which the original modulated signal PWM is in the low level, thus the ripple voltage can be prevented.

Further, by temporarily resuming the operation of the digital power amplifier circuit 28 while stopping the operation of the digital power amplifier circuit 28, it becomes possible to prevent the voltage drop due to the self-discharge of the actuators 22 formed of capacitive loads.

Further, since the drive waveform signal WCOM is stored in the memory 31 as the data of the output voltage difference value Vd, it becomes easy to determine whether or not the voltage of the drive waveform signal WCOM varies.

Further, since the modulation frequency fpwm by the modulator 26 is also stored in the memory 31, it becomes possible to flexibly set the modulation frequency fpwm.

Then, a fluid ejection device according to a second embodiment of the invention will be explained. The fluid ejection device according to the present embodiment is applied to the fluid ejection printer similarly to the first embodiment described above, and the schematic configuration, the vicinity of the fluid ejection head, the control device, the drive signal, the switching controller, the actuator drive circuit, the modulated signal, the gate-source signals, and the output signal are substantially the same as those of the first embodiment described above. The second embodiment is different therefrom in the contents of the data stored in the memory 31, and the arithmetic processing performed by the controller 32 using the stored data.

For example, assuming that the waveform of the drive waveform signal is substantially the same as shown in FIG. 11 of the first embodiment, the data having the contents shown in FIG. 14 is stored in the memory 31 in the second embodiment.

In the second embodiment, the output voltage value (drive waveform voltage data) V of the drive waveform signal WCOM in each of the periods, drive waveform states D0, D2 in each of the periods, and the modulation frequency (PWM frequency in FIG. 14) fpwm in each of the periods are stored in the memory 31. The drive waveform states D0, D2 are expressed with 3 bit data, wherein [000] represents that the voltage of the drive waveform signal WCOM is constant, [011] represents the voltage of the drive waveform signal WCOM changes from constant to increasing, [111] represents that the voltage of the drive waveform signal WCOM continues to vary, [010] represents a change in the voltage of the drive waveform signal WCOM from varying to constant, represents that the operation of the digital power amplifier circuit 28 is temporarily resumed, [100] represents that the operation of the digital power amplifier circuit 28 is stopped, and [001] represents that that the voltage of the drive waveform signal WCOM changes from constant to decreasing.

Figure 15:
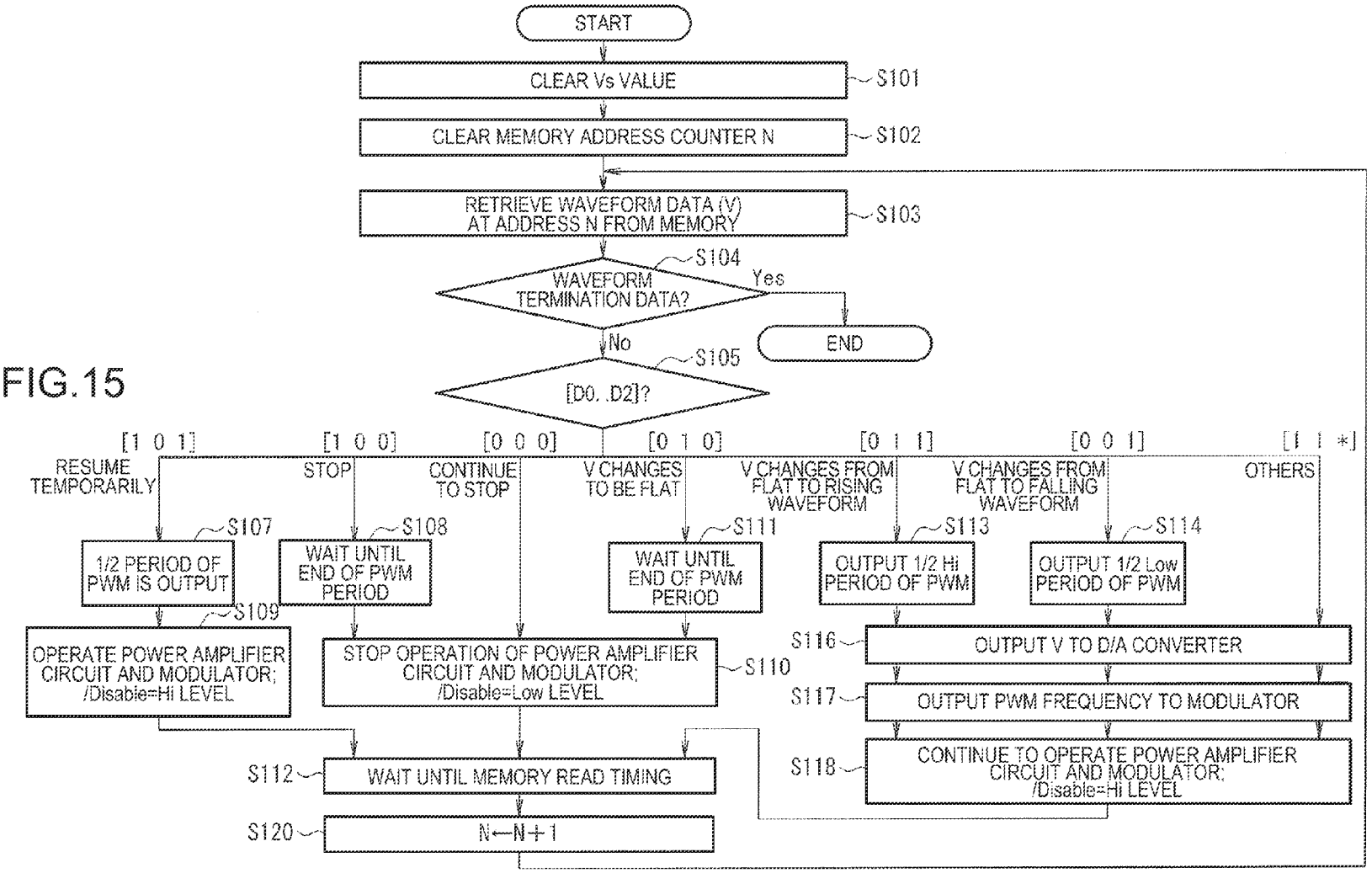
FIG. 15 is a flow chart of arithmetic processing performed by the controller shown in FIG. 7A in accordance with the memory contents shown in FIG. 14.

FIG. 15 is a flowchart of an arithmetic processing performed in the controller 32 using the data stored in the memory 31 shown in FIG. 14. In the arithmetic processing, firstly, the previous voltage value Vs is cleared in the step S101.

Then, the process proceeds to the step S102, and the memory address counter N is cleared.

Subsequently, the process proceeds to the step S103, and the waveform data (the output voltage value) V is retrieved from the memory 31.

Then, the process proceeds to the step S104 to determine whether or not the waveform data (the output voltage value) V retrieved in the step S103 is the waveform termination data, and if it is the waveform termination data, the arithmetic processing is terminated, and otherwise the process proceeds to the step S105.

In the step S105, determination of the waveform states D0, D2 retrieved in the step S103 is performed. In this case, if the drive waveform states D0, D2 are [101], the process proceeds to the step S107 on the ground that the operation of the digital power amplifier circuit 28 is to be resumed temporarily. Further, if the drive waveform states D0, D2 are [100], the process proceeds to the step S108 on the ground that the operation of the digital power amplifier circuit 28 is to be stopped. Further, if the drive waveform states D0, D2 are [000], the process proceeds to the step S110 on the ground that the operation of the digital power amplifier circuit 28 continues to be stopped. If the drive waveform states D0, D2 are [010], the process proceeds to the step S111 on the ground that a change in the voltage of the drive waveform signal WCOM from varying to constant occurs. If the drive waveform states D0, D2 are [011], the process proceeds to the step S113 on the ground that a change in the voltage of the drive waveform signal WCOM changes from constant to increasing occurs. If the drive waveform states D0, D2 are [001], the process proceeds to the step S114 on the ground that a change in the voltage of the drive waveform signal WCOM from constant to decreasing occurs. Further, if the drive waveform states D0, D2 are [11*] (* represents either one of 0 and 1), the process proceeds to the step S116 as other states.

In the step S107, the on-duty period of the modulated signal PWM is reduced to half, and is then output, and the process proceeds to the step S109.

In the step S109, the operation stop signal/Disable is set to be in the high level to make the digital power amplifier circuit 28 and the modulator 26 operate, and the process proceeds to the step S112.

Further, in the step S108, the process waits until the end of the modulation period, and then proceeds to the step S110.

Further, also in the step S111, the process waits until the end of the modulation period, and then proceeds to the step S110.

In the step S110, the operation stop signal/Disable is set to be in the low level, and the operations of the digital power amplifier circuit 28 and the modulator 26 are stopped, and the process proceeds to the step S112.

Incidentally, in the step S113, by controlling the waveform and the waveform output timing of the triangular wave signal TRI as described above, the period in which the modulated signal PWM is kept in the high level is reduced to half of the period in which the original modulated signal is kept in the high level, and is then output, and the process proceeds to the step S116.

Further, in the step S114, by controlling the waveform and the waveform output timing of the triangular wave signal TRI as described above, the period in which the modulated signal PWM is kept in the low level is reduced to half of the period in which the original modulated signal is kept in the low level, and is then output, and the process proceeds to the step S116.

In the step S116, the output voltage value V retrieved in the step S103 is output to the D/A converter 33, and the process proceeds to the step S117.

In the step S117, the modulation frequency fpwm retrieved from the memory 31 is output to the modulator 26 (the triangular wave oscillator 34), and the process proceeds to the step S118.

In the step S118, the operation stop signal/Disable is set to be in the high level, and at the same time, the digital power amplifier circuit 28 and the modulator 26 are made to operate, and the process proceeds to the step S112.

In the step S112, the process waits until the read timing of the memory 31, and then proceeds to the step S120.

In the step S120, the memory address counter N is incremented, and then the process proceeds to the step S103.

According to this arithmetic processing, since the drive waveform signal WCOM is stored in the memory 31 as the output voltage value (the drive waveform voltage data) V, and the memory 31 also stores the drive waveform states (information regarding whether or not the voltage of the drive waveform signal varies) D0, D2, it becomes possible to eliminate the determination itself on whether or not the voltage of the drive waveform signal WCOM varies in addition to the advantage of the first embodiment described above.

Then, a fluid ejection device according to a third embodiment of the invention will be explained. The fluid ejection device according to the third embodiment is applied to the fluid ejection printer similarly to the first embodiment described above, and the schematic configuration, the vicinity of the fluid ejection head, the control device, the drive signal, the switching controller, the actuator drive circuit, the modulated signal, the gate-source signals, and the output signal are substantially the same as those of the first embodiment described above. The third embodiment is different therefrom in the contents of the data stored in the memory 31, and the arithmetic processing performed by the controller 32 using the stored data. For example, assuming that the waveform of the drive waveform signal is substantially the same as shown in FIG. 11 of the first embodiment, the data having the contents shown in FIG. 16 is stored in the memory 31 in the third embodiment. In the third embodiment, the output voltage value (drive waveform voltage data) V of the drive waveform signal WCOM in each of the periods, and the modulation frequency (PWM frequency in FIG. 16) fpwm in each of the periods are stored in the memory 31.

Figure 17:
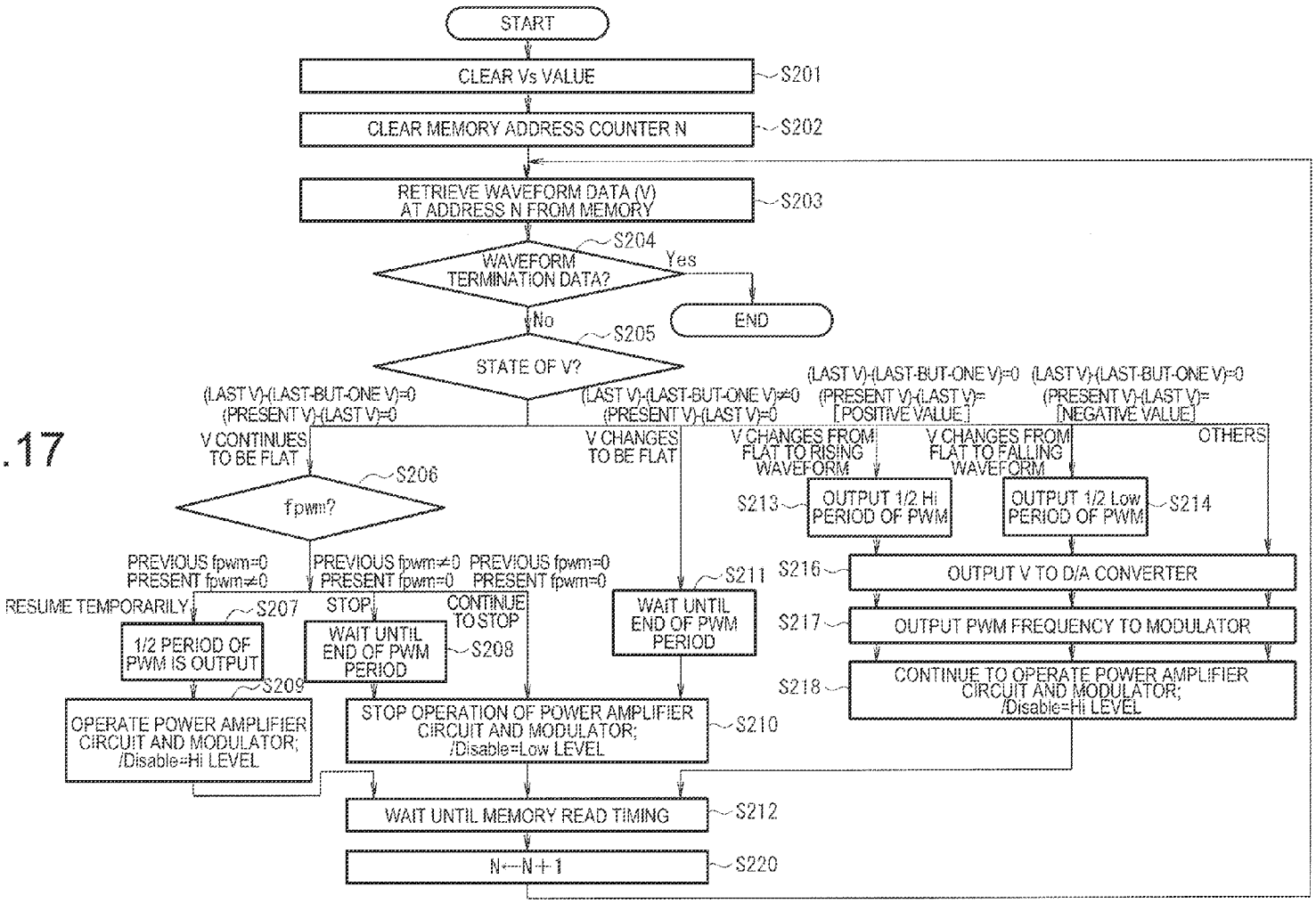
FIG. 17 is a flow chart of arithmetic processing performed by the controller shown in FIG. 7A in accordance with the memory contents shown in FIG. 16.

FIG. 17 is a flowchart of an arithmetic processing performed in the controller 32 using the data stored in the memory 31 shown in FIG. 16. In the arithmetic processing, firstly, the previous voltage value Vs is cleared in the step S201.

Then, the process proceeds to the step S202, and the memory address counter N is cleared.

Subsequently, the process proceeds to the step S203, and the waveform data (the output voltage value) V is retrieved from the memory 31.

Then, the process proceeds to the step S204 to determine whether or not the waveform data (the output voltage value) V retrieved in the step S203 is the waveform termination data, and if it is the waveform termination data, the arithmetic processing is terminated, and otherwise the process proceeds to the step S205.

In the step S205, determination of the waveform data (the output voltage value) V retrieved in the step S203 is performed. In this case, if the value obtained by subtracting the last-but-one output voltage value V from the last output voltage value V is 0, and the value obtained by subtracting the last output voltage value V from the output voltage value V retrieved presently is also 0, the process proceeds to the step S206 on the ground that the voltage of the drive waveform signal WCOM stays constant. If the value obtained by subtracting the last-but-one output voltage value V from the last output voltage value V is not 0, and the value obtained by subtracting the last output voltage value V from the output voltage value V retrieved presently is 0, the process proceeds to the step S211 on the ground that the drive waveform signal WCOM has become constant. If the value obtained by subtracting the last-but-one output voltage value V from the last output voltage value V is 0, and the value obtained by subtracting the last output voltage value V from the output voltage value V retrieved presently is a positive value, the process proceeds to the step S213 on the ground that a change in the voltage of the drive waveform signal WCOM from constant to increasing occurs. Further, if the value obtained by subtracting the last-but-one output voltage value V from the last output voltage value V is 0, and the value obtained by subtracting the last output voltage value V from the output voltage value V retrieved presently is a negative value, the process proceeds to the step S214 on the ground that there a change in the voltage of the drive waveform signal WCOM from constant to decreasing. Otherwise the process proceeds to the step S216.

In the step S206, determination of the modulation frequency fpwm retrieved from the memory 31 is performed. In this case, if the previous modulation frequency fpwm is 0, and the modulation frequency fpwm retrieved presently is not 0, the process proceeds to the step S207 on the ground that the operation of the digital power amplifier circuit 28 is to be resumed temporarily. Further, if the previous modulation frequency fpwm is not 0, and the modulation frequency fpwm retrieved presently is 0, the process proceeds to the step S208 on the ground that the operation of the digital power amplifier circuit 28 is to be stopped. Further, if the previous modulation frequency fpwm is 0, and the modulation frequency fpwm retrieved presently is also 0, the process proceeds to the step S210 on the ground that the operation of the digital power amplifier circuit 28 continues to be stopped.

In the step S207, the on-duty period of the modulation signal PWM is reduced to half, and is then output, and the process proceeds to the step S209.

In the step S209, the operation stop signal/Disable is set to be in the high level to make the digital power amplifier circuit 28 and the modulator 26 operate, and the process proceeds to the step S212.

Further, in the step S208, the process waits until the end of the modulation period, and then proceeds to the step S210.

Further, also in the step S211, the process waits until the end of the modulation period, and then proceeds to the step S210.

In the step S210, the operation stop signal/Disable is set to be in the low level, and at the same time, the operations of the digital power amplifier circuit 28 and the modulator 26 are stopped, and the process proceeds to the step S212.

Incidentally, in the step S213, by controlling the waveform and the waveform output timing of the triangular wave signal TRI as described above, the period in which the modulated signal PWM is kept in the high level is reduced to half of the period in which the original modulated signal is kept in the high level, and is then output, and the process proceeds to the step S216.

Further, in the step S214, by controlling the waveform and the waveform output timing of the triangular wave signal TRI as described above, the period in which the modulated signal PWM is kept in the low level is reduced to half of the period in which the original modulated signal is kept in the low level, and is then output, and the process proceeds to the step S216.

In the step S216, the output voltage value V retrieved in the step S203 is output to the D/A converter 33, and the process proceeds to the step S217.

In the step S217, the modulation frequency fpwm retrieved from the memory 31 is output to the modulator 26 (the triangular wave oscillator 34), and the process proceeds to the step S218.

In the step S218, the operation stop signal/Disable is set to be in the high level, and at the same time, the digital power amplifier circuit 28 and the modulator 26 are made to operate, and the process proceeds to the step S212.

In the step S212, the process waits until the read timing of the memory 31, and then proceeds to the step S220.

In the step S220, the memory address counter N is incremented, and then the process proceeds to the step S203.

According to the arithmetic processing, since it is arranged that the drive waveform signal WCOM is stored in the memory 31 as the output voltage value (the drive waveform voltage data) V, the controller 32 calculates the difference of the output voltage value (the drive waveform voltage data) V retrieved from the memory 31, and the operation of the digital power amplifier circuit 28 is stopped if the difference in the output voltage value (the drive waveform voltage data) V is 0, the memory 31 with small capacity can be adopted in addition to the advantages of the first and second embodiments described above.

Figure 18A:
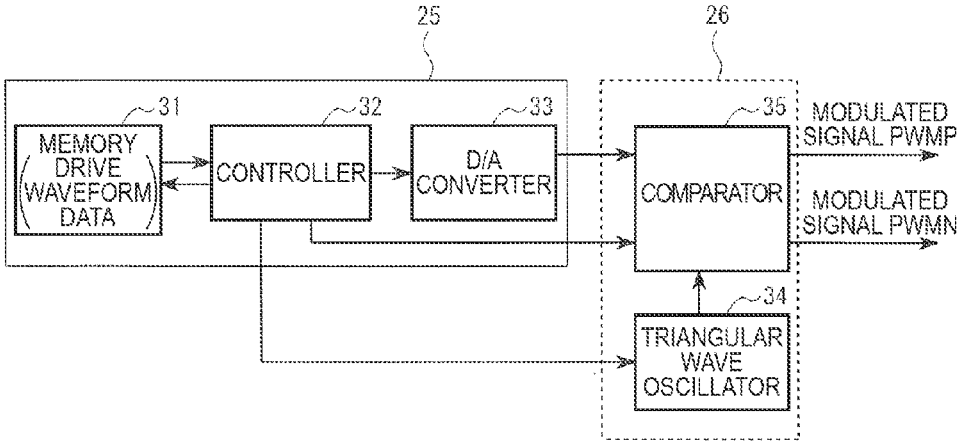
FIGS. 18A and 18B are detailed block diagrams showing another example of the drive circuit shown in FIG. 6.
Figure 18B:
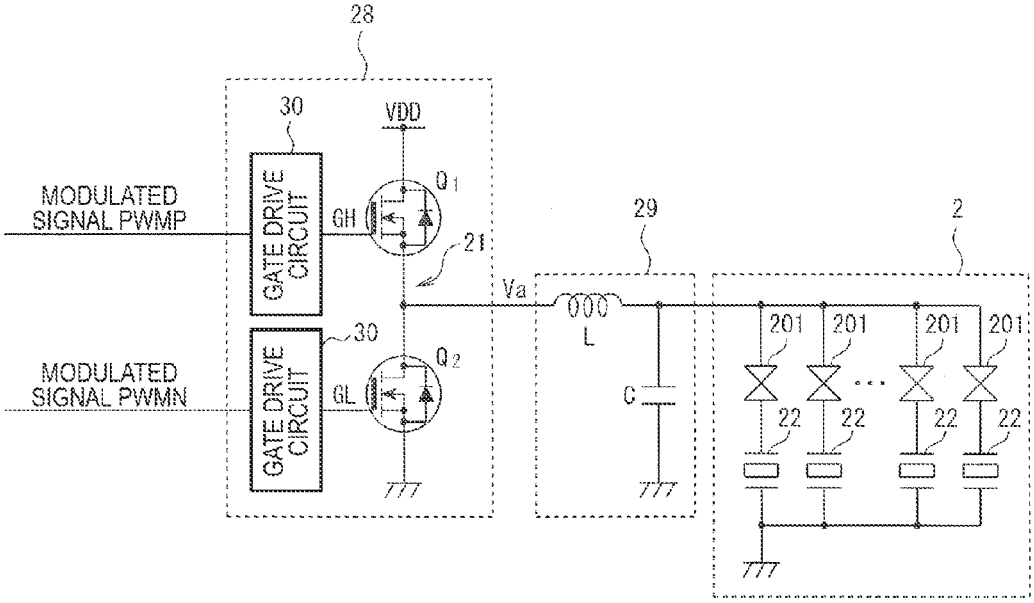

Then, a modified example of the actuator drive circuit described above will be explained. FIGS. 18A and 18B are block diagrams showing another example of the actuator drive circuit. This actuator drive circuit is similar to the actuator drive circuit shown in FIGS. 7A and 7B described above, and the equivalent constituents are denoted by the equivalent reference numerals, and detailed explanation thereof will be omitted. In the actuator drive circuit shown in FIGS. 7A and 7B described above, the controller 32 outputs the operation stop signal/Disable to the gate drive circuit 30, and when the operation stop signal/Disable is in the low level, both of the high-side switching element Q1 and the low-side switching element Q2 of the digital power amplifier circuit 28 are OFF to thereby stop the operation of the digital power amplifier circuit 28. This is because, as described above, in the case in which only one gate drive circuit 30 is provided, and, for example, the gate-source signal GL to the low-side switching element Q2 is obtained by inverting the gate-source signal GH to the high-side switching element Q1, and is then output, it is not achievable to set both of the gate-source signals GH, GL to the high-side switching element Q1 and the low-side switching element Q2 to be in the low level.

Therefore, in the present modified example, the gate drive circuit 30 is provided to each of the high-side switching element Q1 and the low-side switching element Q2. Further, it is arranged that the comparator 35 outputs a pulse-modulated signal PWMP taking the high level when the drive waveform signal WCOM is higher than the triangular wave signal TRI, and an inverted pulse-modulated signal PWMN, so that the pulse-modulated signal PWMP is output to the gate drive circuit 30 for the high-side switching element Q1, and the inverted pulse-modulated signal PWMN is output to the gate drive circuit 30 for the low-side switching element Q2. When stopping the digital power amplifier circuit 28, namely in the case in which the voltage of the drive waveform signal WCOM does not change, the controller 32 holds both of the modulated signals PWMP, PWMN output from the comparator 35 in the low level. Thus, the gate-source signals GH, GL output from the respective two gate drive circuits 30 are set to be in the low level, and both of the high-side switching element Q1 and the low-side switching element Q2 are OFF. The operation and the stop of the operation of the digital power amplifier circuit 28 are as shown in the truth table shown in Table 2 below.

TABLE 2

| Pulse Modulation Signal P | Pulse Modulation Signal N | Q1 | Q2 | Power Amplifier |
|---|---|---|---|---|
| 0 | 0 | OFF | OFF | Stopped |
| 1 | 0 | ON | OFF | Operating |
| 0 | 1 | OFF | ON | |
| 1 | 1 | ON | ON | |

It should be noted that although in the first through third embodiments described above only the case in which the fluid ejection device according to an aspect of the invention is applied to the line head-type printer is described in detail, the fluid ejection device according to an aspect of the invention can also be applied to multi-pass type printer in a similar manner.

Further, the fluid ejection device according to an aspect of the invention can also be embodied as a fluid ejection device for ejecting a fluid (including a fluid like member dispersing particles of functional materials, and a fluid such as a gel besides fluids) other than the ink, or a fluid (e.g., a solid substance capable of flowing as a fluid and being ejected) other than fluids. The fluid ejection device can be, for example, a fluid like member ejection device for ejecting a fluid like member including a material such as an electrode material or a color material used for manufacturing a fluid crystal display, an electroluminescence (EL) display, a plane emission display, or a color filter in a form of a dispersion or a solution, a fluid ejection device for ejecting a living organic material used for manufacturing a biochip, or a fluid ejection device used as a precision pipette for ejecting a fluid to be a sample. Further, the fluid ejection device can be a fluid ejection device for ejecting lubricating oil to a precision machine such as a timepiece or a camera in a pinpoint manner, a fluid ejection device for ejecting on a substrate a fluid of transparent resin such as ultraviolet curing resin for forming a fine hemispherical lens (an optical lens) used for an optical communication device, a fluid ejection device for ejecting an etching fluid of an acid or an alkali for etching a substrate or the like, a fluid ejection device for ejecting a gel, or a fluid ejection recording apparatus for ejecting a solid substance including fine particles such as a toner as an example. Further, an aspect of the invention can be applied to either one of these ejection devices.

What is claimed is:

1. A fluid ejection device comprising:

a modulator that modulates a drive waveform signal and outputs a modulated signal;

a digital power amplifier circuit that power-amplifies the modulated signal and outputs a power-amplified modulated signal;

a low pass filter that smoothes the power-amplified modulated signal and outputs a drive signal; and a controller that outputs an operation stop signal for stopping an operation of the digital power amplifier circuit when a drive waveform data that is basis of the drive waveform signal is a data that is converted to the drive waveform signal of constant voltage.

2. The fluid ejection device according to claim 1, wherein the digital power amplifier circuit has two switching elements; and the controller stops an operation of the digital power amplifier circuit by switching off the two switching elements.

3. The fluid ejection device according to claim 1, wherein the digital power amplifier circuit is configured including a half-bridge output stage;

the half-bridge output stage is composed of a high-side switching element and a low-side switching element; and the controller stops an operation of the digital power amplifier circuit by switching off the high-side switching element and the low-side switching element.

4. The fluid ejection device according to claim 1, wherein the digital power amplifier circuit is configured including a half-bridge output stage and the gate drive circuit;

the half-bridge output stage is composed of a high-side switching element and a low-side switching element;

the gate drive circuit controls the high-side switching element and the low-side switching element based on the modulated signal from the modulator; and the controller stops an operation of the digital power amplifier circuit by switching off the high-side switching element and the low-side switching element.

5. The fluid ejection device according to claim 1, wherein the modulator stops outputting the modulated signal when the operation of the digital power amplifier circuit is stopped by the controller.

6. The fluid ejection device according to claim 1, wherein the modulator pulse-modulates the drive waveform signal using a first modulation frequency; and the modulator modulates the drive waveform signal using a higher frequency than the first modulation frequency when the drive waveform signal changes from a varying to a constant state.

7. The fluid ejection device according to claim 1, wherein the modulator pulse-modulates the drive waveform signal using a first modulation frequency; and the modulator modulates the drive waveform signal using a higher frequency than the first modulation frequency when the drive waveform signal changes from a constant state to a varying state.

8. The fluid ejection device according to claim 1, wherein the modulator outputs the modulated signal in a high level for a first period and in a low level for a second period; and the first or the second period immediately after a transition from a constant to a varying state is halved.

9. The fluid ejection device according to claim 1, wherein the controller temporarily resumes the operation of the digital power amplifier circuit while the operation of the digital power amplifier circuit is being stopped.

10. The fluid ejection device according to claim 1, further comprising:

a memory adapted to store the drive waveform signal, wherein:

the memory stores the drive waveform data; and the drive waveform data is a drive waveform voltage difference data.

11. The fluid ejection device according to claim 10, wherein the memory stores a modulation frequency.

12. The fluid ejection device according to claim 1, further comprising:

a memory adapted to store the drive waveform signal, wherein the memory stores the drive waveform data and an information regarding whether the voltage of the drive waveform signal is varying or not.

13. The fluid ejection device according to claim 1, further comprising:

a memory adapted to store the drive waveform signal, wherein:

the memory stores the drive waveform_data; and the controller calculates a difference between the drive waveform_data retrieved from the memory, and stops the operation of the digital power amplifier circuit when the difference indicates a 0.

14. The fluid ejection device according to claim 1, wherein the digital power amplifier circuit is configured including a half-bridge output stage and the gate drive circuit;

the half-bridge output stage is composed of a high-side switching element and a low-side switching element for substantially amplifying the power; and the gate drive circuit controls the gate-source signals GH, GL of the high-side switching element and the low-side switching element based on the modulated signal from the modulator.

15. The fluid ejection device according to claim 1, wherein the digital power amplifier circuit is configured including a half-bridge output stage and the gate drive circuit;

the half-bridge output stage is composed of a high-side switching element and a low-side switching element;

the gate drive circuit controls the high-side switching element and the low-side switching element based on the modulated signal from the modulator.

16. A fluid ejection printer comprising:

the fluid ejection device according to claim 1.

* * * * *